US006598608B1

(12) United States Patent
Downey

(10) Patent No.: US 6,598,608 B1
(45) Date of Patent: Jul. 29, 2003

(54) COSMETICS SAMPLING METHOD AND COSMETICS SAMPLER FILM

(76) Inventor: Margarita Downey, Apartado 229-2050 (CR)

( * ) Notice: Subject to any disclaimer, the term of this patent is extended or adjusted under 35 U.S.C. 154(b) by 285 days.

(21) Appl. No.: 09/614,883

(22) Filed: Jul. 12, 2000

(51) Int. Cl.[7] ..... A45D 40/30
(52) U.S. Cl. ..... 132/200; 132/319
(58) Field of Search ..... 132/73, 319, 285, 132/200; 434/377, 367, 84, 99, 100; 206/730, 733, 735

(56) References Cited

U.S. PATENT DOCUMENTS

| | | | | | |
|---|---|---|---|---|---|
| 1,960,669 | A | * | 5/1934 | Freedman | 132/319 |
| 1,979,119 | A | * | 10/1934 | Radzinsky | 132/319 |
| 1,990,630 | A | | 2/1935 | Bensel | |
| 2,020,100 | A | * | 11/1935 | Boyd | 132/319 |
| 2,088,076 | A | | 7/1937 | Winslow | |
| 2,237,162 | A | | 4/1941 | Robinson | |
| 2,288,382 | A | * | 6/1942 | Belden | 132/73 |
| 2,393,371 | A | | 1/1946 | Harris | |
| 2,417,677 | A | | 3/1947 | Cohan | |
| 2,623,304 | A | * | 12/1952 | Watson | 132/319 |
| 4,915,234 | A | | 4/1990 | Boeller | |
| 5,090,910 | A | | 2/1992 | Narlo | |
| 5,178,169 | A | | 1/1993 | Lamie | |
| 5,358,407 | A | * | 10/1994 | Lainer | 434/99 |
| 5,441,412 | A | | 8/1995 | Hayles | |
| 5,562,109 | A | | 10/1996 | Tobiason | |
| 5,570,793 | A | | 11/1996 | Killough | |
| 5,690,130 | A | | 11/1997 | Gunderman et al. | |
| 5,860,809 | A | | 1/1999 | Meehan | |
| 6,035,867 | A | * | 3/2000 | Barrick | 132/319 |
| 6,250,927 | B1 | * | 6/2001 | Nario | 434/100 |

* cited by examiner

*Primary Examiner*—Todd E. Manahan
(74) *Attorney, Agent, or Firm*—Paul S. Rooy, P.A.

(57) ABSTRACT cosmetics sampling method and cosmetics sampler film. The cosmetics sampler film is a transparent film bearing cosmetics depiction(s) such as lips, eye shadow, eye liner, lip liner, rouge, face powder and fingernail polish. Each cosmetics depiction has associated indicia. When the cosmetics depictions are lips, eye shadow, eye liner, lip liner, rouge or face powder the indicia is reversed indicia whose mirror image is legible, conventional type. In the case of these cosmetics depictions, the cosmetics sampling method includes the steps of superimposing one of the cosmetics depictions over a corresponding consumer body part (e.g. superimposing a lip depiction over the consumer's lips), observing the superimposition in a mirror, and noting the reflected image of the reversed indicia corresponding to the cosmetics depiction thus superimposed for later reference in purchasing the cosmetic depicted. Where the cosmetic depicted is a fingernail polish depiction, the cosmetics sampling method includes the steps of superimposing a fingernail polish depiction over a consumer fingernail, observing the superimposition directly, and noting the indicia corresponding to the cosmetics depiction thus superimposed for later reference in purchasing the cosmetic depicted.

10 Claims, 4 Drawing Sheets

COSMETICS SAMPLING METHOD AND COSMETICS SAMPLER FILM

BACKGROUND OF THE INVENTION

1. Field of the Invention

This invention relates to cosmetics, and in particular to a cosmetics sampling method and cosmetics sampler film.

2. Background of the Invention

Cosmetics have been used by both sexes for thousands of years. As early as 4000 B.C. the ancient Egyptians used perfumes and body oils for protection against the hot dry climate, as well as for aesthetic reasons. As time passed, the Egyptians, Greeks and Romans learned to make cosmetics from plants. Powdered minerals were also used in the production of hair dyes, face, and eye makeup.

By 1100 A.D. cosmetics and their use had spread to Western Europe. During the same approximate time frame African cultures used war and religious ceremony body paints. American Indians used preparations made from animal fats for protection against the cold and insects long before European settlers arrived. In turn, the European settlers also brought cosmetics with them to the New World.

By the early 1900's, the use of face powder, rouge, lipstick and shampoo was fairly widespread on a world-wide basis. The demand and variety of available cosmetics increased dramatically from the 1930's on, attributable largely to the promotion and advertising efforts of cosmetics manufacturers.

Today the world-wide cosmetics industry generates billions of dollars each year in sales. A wide variety of cosmetics are available, including lipstick, lip liner, eye shadow, eye liner, fingernail polish, rouge and face powder.

Attendant with the tremendous demand for cosmetics come the problems of how to provide effective and sanitary sampling for potential purchasers of the different color shades, intensities, and vibrancies of the different cosmetics. Consumers understandably wish to observe how a given cosmetic product looks applied to their own skin prior to purchase. Because everyone has different skin characteristics, the appearance of a specific cosmetic may vary depending upon to whose lips, skin or fingernails it is applied.

Traditionally, in some up-scale stores, sampler tubes of lipstick, etc. have been made available for customers to use in sampling the cosmetics. A major problem associated with this approach is the large expense of providing a sampler tube of each and every one of the myriad colors and shades available for each product. This expense alone dissuades most stores form offering cosmetics samplers at all. Another problem associated with this sampler approach is the bulk of the sampler container: one cannot easily slip a number of tear-out sampler tubes of lipstick between the pages of a fashion magazine for the consumer to try out at home. Still another problem associated with the sampler approach is sanitation: many consumers are loath to use a cosmetic applicator, be,it an eyeliner brush or a tube of lipstick, which has previously been used by an indeterminate number of strangers of unknown health and personal hygiene habits. Needless to say, in today's litigious legal environment, where a store sampler which has been used by numerous individuals infects a consumer with some serious disease, the legal liability of that store to the infected consumer could become substantial.

Due to the lack of a sanitary, economical, comprehensive and effective cosmetic sampling method, and the looming liability issue, most stores simply do not offer cosmetics sampling, either by their own choice or in acquiescence to the limitations of their liability insurance carrier. This pervasive lack of cosmetic sampling capability has given rise to a population of shadow criminals. These shadow criminals are comprised of otherwise law-abiding citizens, most female, who are forced to furtively break the seal of store stock cosmetic containers in order to apply a small amount of the enclosed cosmetic to their skin, in order to get some idea what the cosmetic will look like when applied. Given the elevated prices commanded by quality cosmetics, it is simply unreasonable to expect the average consumer of limited means to buy without trying the cosmetic out first. Yet in the face of this entirely reasonable sampling need, most stores do not, or feel they cannot, provide samples!

This sad state of cosmetics sampling affairs has forced consumers to sample from store stock. At a minimum this action constitutes shop-lifting, and if the cosmetic is sufficiently pricey, could even amount to grand theft.

It is clear that a crying need exists for a method of sampling cosmetics which is inexpensive, yet which provides quick and easy sampling of the entire range of a manufacturer's products. Even a single manufacturer could offer dozens of different shades in lipsticks alone, not to mention the numerous shades of lip liner, eye shadow, eye liner, fingernail polish, rouge and face powder produced by that same manufacturer. When all these varieties of cosmetics available from a single manufacturer are multiplied by the number of cosmetics manufacturers on the market today, it is easy to see that a comprehensive cosmetics sampling method must provide sampling of hundreds, maybe thousands, of individual products.

In addition, it is crucial that the cosmetic sampling method be reasonably sanitary, for the reasons given above. Finally, the cosmetic sampling method must provide for an apparatus which is small and easily stored. There are a number of reasons for this compactness requirement: given the high cost of retail store floor and counter space, and given the hundreds or thousands of individual cosmetic products which must be sampled, absent a very compact apparatus, storage cost and display counter space cost of the sampling apparatus could be prohibitive. Another reason for compactness is the ability to deliver samplers to consumers to try in their homes or work places, via stand-alone mailers, magazine tear-out sheets, newspaper or other publication inserts, etc., to name only a few delivery methods.

EXISTING DESIGNS

A number of approaches have been attempted to solve this cosmetics sampling problem. U.S. Pat. Nos. 5,860,809 2,020,100, 2,393,371, 2,417,677, 1,990,630 and 5,570,793 have been granted Meehan, Boyd, Harris, Cohan, Bensel, and Killough respectively. These designs provided color chips embedded in an apparatus, color wheel, or mirror. While some idea of the "look" provided the consumer by a given cosmetic was afforded by these designs, they suffered from a number of drawbacks. All were complex and hence expensive, and each accommodate only a relatively small number of shades. Most of them taught only fingernail polish samplers, not lipstick, lip liner, eye shadow, eye liner, rouge or face powder sampling.

Winslow's U.S. Pat. No. 2,088,076 did teach a lipstick sampler which comprised a pair of lips to which tabs were connected. The consumer was expected to grip the tabs between her teeth, thus holding the artificial pair of lips against her own. This apparatus suffered from sanitation problems, in that the germs from previous users could be introduced into the mouth of subsequent users. In addition, each apparatus displayed only one lipstick shade, thus rendering storage of hundreds or thousands of these items bulky and unwieldy.

U.S. Pat. No. 5,441,412 was granted Hayles. This patent taught a series of transparencies overlaid on a backing sheet intended to represent the face of the consumer. This approach suffered from a number of problems. The major problem appeared to be lack of realism: the backing sheet intended to represent the face of the consumer was at best a rough approximation, so an exact picture of how a given cosmetic would look on a specific consumer was not possible. In addition, each transparency appeared to be roughly 9 inches×12 inches, and each transparency contained only a single cosmetic sample. Therefore the method and apparatus taught by the Hayles patent was bulky, and storage of hundreds or thousands of transparencies would require a fair amount of space.

Robinson was granted U.S. Pat. No. 2,237,162 for a fingernail polish sampler swivelably attached to a fingernail polish bottle cap. The sampler comprised a fingernail-shaped color chip which could be swivelled out from the cap and superimposed on a consumer's fingernail to illustrate the way the fingernail polish enclosed in the bottle would look. This approach suffered from many of the drawbacks of the approaches previously described. Each apparatus displayed only one fingernail polish shade. No provision was taught for lipstick, lip liner, eye shadow, eye liner, rouge or face powder sampling. Finally, the arrangement disclosed was complex and expensive, thus rendering the '162 apparatus and method economically impractical when applied to large numbers of samples.

SUMMARY OF THE INVENTION

Accordingly, it is an object of the present invention to provide a cosmetics sampler film which provides a quick, easy and accurate depiction of how cosmetics including lipstick, lip liner, eye shadow, eye liner, fingernail polish, rouge and face powder will look on a consumer. Design features allowing this object to be accomplished include a transparent film bearing at least one lip depiction, lip liner depiction, eye shadow depiction, eye liner depiction, fingernail polish depiction, rouge depiction, or face powder depiction. Advantages associated with the accomplishment of this object include simplicity, low cost, and the ability of a specific consumer to accurately assess how a given cosmetic looks on her own unique face or hands.

It is another object of the present invention to provide a cosmetics sampling method which provides a quick, easy and accurate depiction of how cosmetics including lipstick, lip liner, eye shadow, eye liner, fingernail polish, rouge and face powder will look on a consumer. Method steps allowing this object to be accomplished include superimposing a lip depiction, lip liner depiction, eye shadow depiction, eye liner depiction, fingernail polish depiction, rouge depiction, or face powder depiction on the consumer's own lips, eye, fingernail, cheeks or face. Benefits associated with the accomplishment of this object include simplicity, low cost, and the ability of a specific consumer to accurately assess how a given cosmetic looks on her own unique face or hands.

It is still another object of this invention to provide a cosmetics sampling method which is sanitary to use. Method steps enabling the accomplishment of this object include superposition of a film bearing cosmetic depictions over the consumer's own lips, eye, fingernail, cheeks or face, without introducing any part of the cosmetic sampler film into the consumer's mouth. Advantages associated with the realization of this object include reduced risk of disease run by the consumer, and reduced liability risk run by the store.

It is another object of the present invention to provide a cosmetics sampling method and cosmetics sampler film which permits a consumer to select the best cosmetics choice from many cosmetic product offerings. Design features allowing this object to be accomplished include a plurality of transparent films, each bearing a plurality of cosmetics depictions, and indicia or reversed indicia, as appropriate, associated with each individual cosmetic depiction. Benefits associated with the accomplishment of this object include consumer convenience and satisfaction, and increased vendor sales.

It is still another object of this invention to provide a cosmetics sampling film which is compact. Design features enabling the accomplishment of this object include a plurality of transparent films, each bearing a plurality of cosmetics depictions. Advantages associated with the realization of this object include reduced retail counter space required, and associated cost savings.

It is yet another object of this invention to provide a cosmetics sampling film which is inexpensive. Design features allowing this object to be achieved include the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Four sheets of drawings are provided. Sheet one contains FIGS. 1 and 2. Sheet two contains FIGS. 3, 4 and 5. Sheet three contains FIGS. 6 and 7. Sheet four contains FIG. 8.

DETAILED DESCRIPTION OF THE PREFERRED EMBODIMENT

Figure 1:
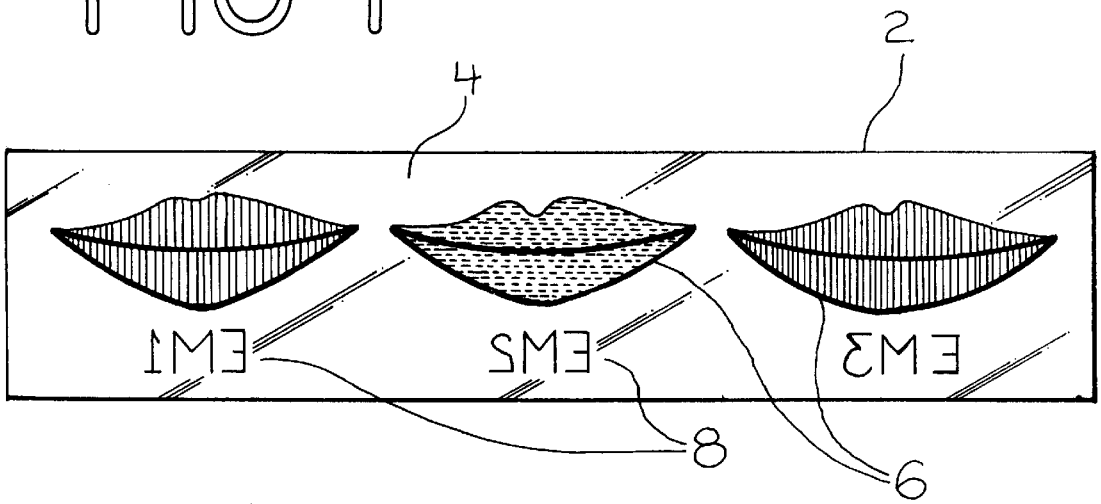
FIG. 1 is a front view of a lipstick sampler film.
Figure 2:
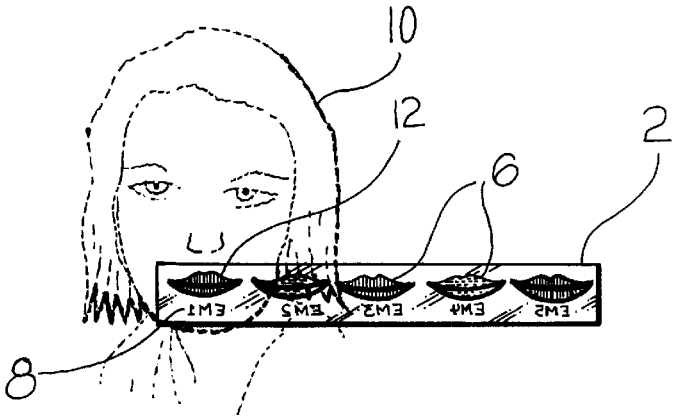
FIG. 2 is a front view of a lipstick sampler film superimposed on a consumer's lips.

Referring now to FIG. 1 we observe a front view of lipstick sampler film 2. Lipstick sampler film 2 comprises transparent film 4 upon which at least one lip depiction 6 is printed. Lip depiction(s) 6 may be fotorealistic depictions of a pair of lips wearing a specific shade of lipstick, or in the alternative may simply constitute shading, possibly translucent, so that a consumer superimposing lip depiction 6 over her own consumer lips 12 (as shown in FIG. 2) appears to see her own lips, bearing the lipstick color depicted by lip depiction 6. Each lip depiction 6 printed on transparent film 4 has with it identifying reversed indicia 8. Reversed indicia 8 is a mirror image of conventional print. It is reversed so that its mirror reflection appears to be conventional, easily legible print identifying the specific cosmetic with which it is associated, so that the consumer may later purchase that specific cosmetic if she so desires.

FIG. 2 is a front isometric view of a lipstick sampler film 2 superimposed on consumer lips 12 belonging to consumer 10. Transparent film 2 is made of stiff, transparent material such as clear plastic or clear celluloid, and thus contains sufficient inherent rigidity to maintain its shape when held at one end, with the other end superimposed over consumer lips 12.

FIG. 2 depicts the way that the instant cosmetics sampler film is used: the specific cosmetic depiction to be sampled is held over the appropriate consumer body part (e.g lips, eyes, fingernail, face, etc.), and the result observed in a mirror. In this manner, a consumer may quickly and easily sample a large number of cosmetics. When a cosmetic is identified as being purchase-worthy, the consumer notes its identifying reversed indicia 8 by its mirrored reflection, and simply purchases the cosmetic thus identified. This procedure is modified slightly in the case of fingernail polish. Because a consumer can observe her fingernails directly, without having to avail herself of a mirror, indicia 36 is employed, which is conventional print, not reversed print. Indicia 36 may be read directly from the fingernail polish sampler film 32. For the same reason, the consumer needs not avail herself of a mirror in order to view a fingernail polish sampler film superimposed on her fingernails. Instead, the consumer superimposes fingernail polish sampler film 32 on her fingernail, and views the results directly.

Figure 3:
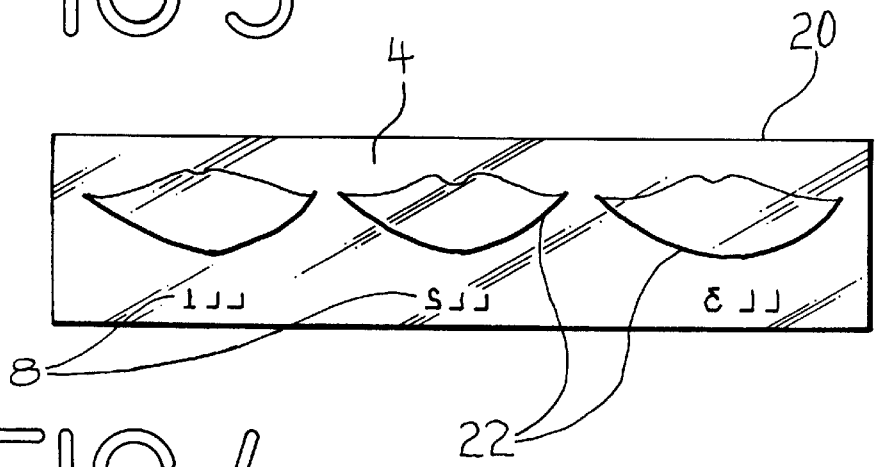
FIG. 3 is a front view of a lip liner sampler film.

FIG. 3 is a front view of lip liner sampler film 20. Lip liner sampler film 20 comprises at least one lip liner depiction 22 printed on transparent film 4, along with its associated reversed indicia 8.

Figure 4:
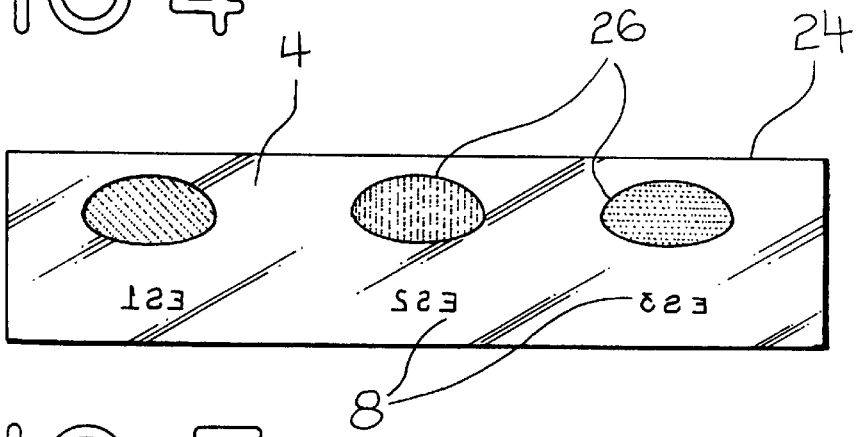
FIG. 4 is a front view of an eye shadow sampler film.

FIG. 4 is a front view of eye shadow sampler film 24. Eye shadow sampler film 24 comprises at least one eye shadow depiction 26 printed on transparent film 4, along with its associated reversed indicia 8.

Figure 5:
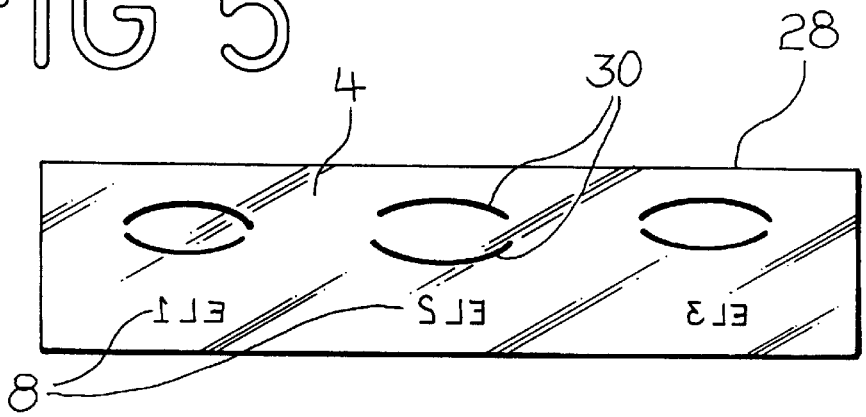
FIG. 5 is a front view of an eye liner sampler film.

FIG. 5 is a front view of eye liner sampler film 28. Eye liner sampler film 28 comprises at least one eye liner depiction 30 printed on transparent film 4, along with its associated reversed indicia 8.

Figure 6:
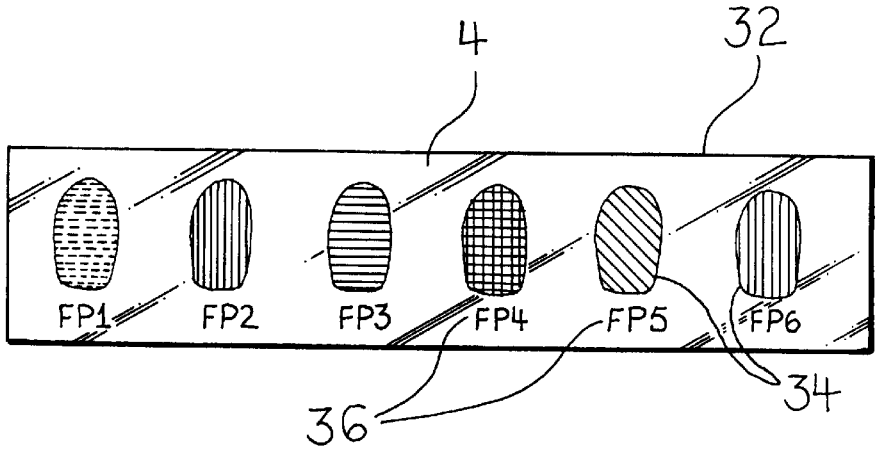
FIG. 6 is a front view of a fingernail polish sampler film.

FIG. 6 is a front view of fingernail polish sampler film 32. Fingernail polish sampler film 32 comprises at least one fingernail polish depiction 34 printed on transparent film 4, along with its associated indicia 36.

Figure 7:
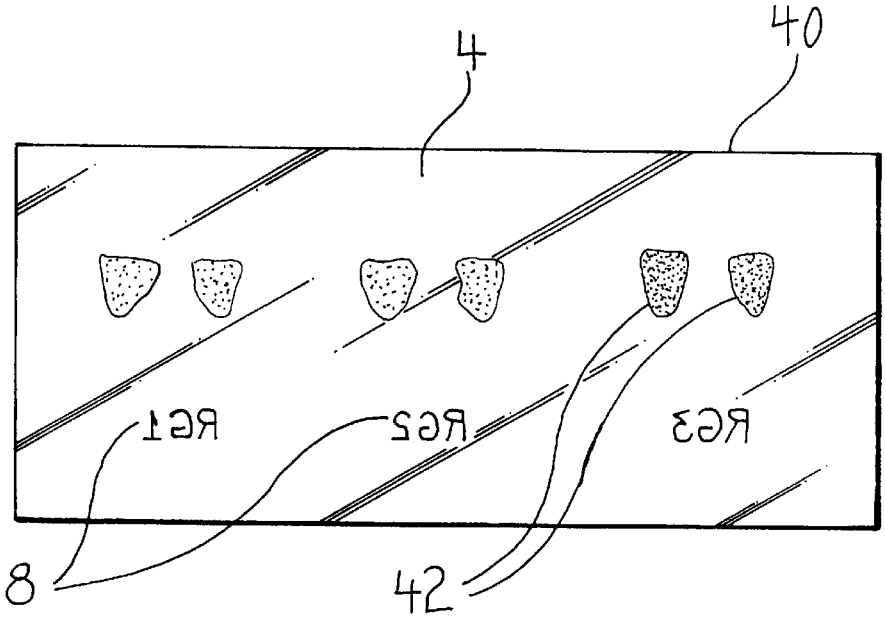
FIG. 7 is a front view of a rouge sampler film.

FIG. 7 is a front view of rouge sampler film 40. Rouge sampler film 40 comprises at least one rouge depiction 42 printed on transparent film 4, along with its associated reversed indicia 8.

Figure 8:
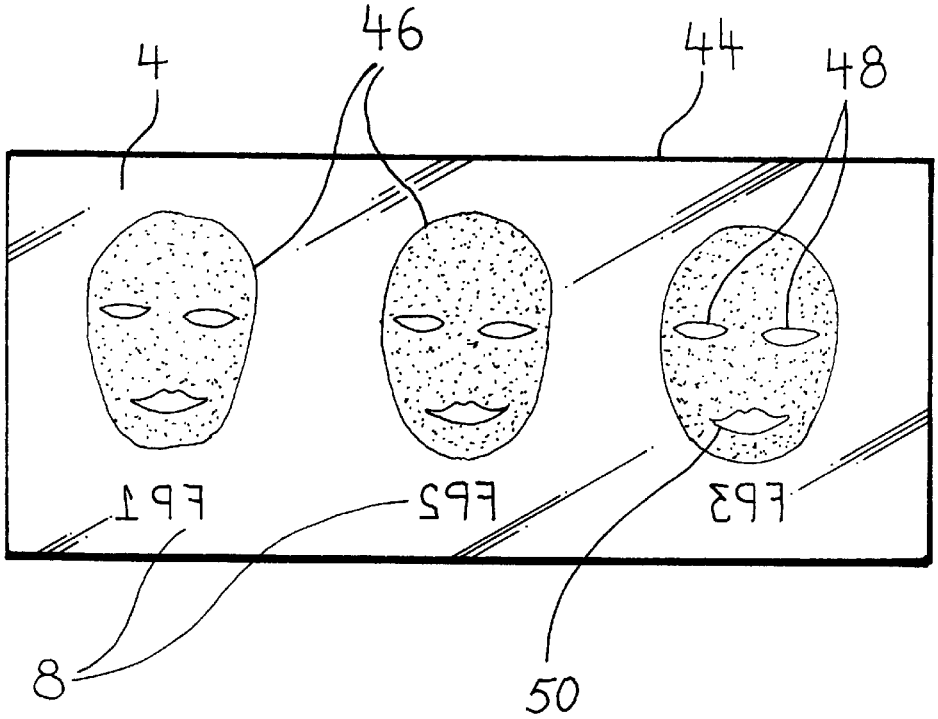
FIG. 8 is a front view of a face powder sampler film.

FIG. 8 is a front view of face powder sampler film 44. Face powder sampler film 44 comprises at least one face powder depiction 46 printed on transparent film 4, along with its associated reversed indicia 8. Each face powder depiction 46 comprises a pair of eye depictions 48 and a lips depiction 50, for added realism.

COSMETIC SAMPLING METHOD:

The cosmetic sampling method used for lipstick sample film 2, lip liner sampler film 20, eye 13 shadow sampler film 24, eye liner sampler film 28, rouge sampler film 40 and face powder sampler film 44 is as follows:

A. Superimposing a cosmetic depiction over the corresponding consumer body part;

B. Observing the superposition in a mirror;

C. Noting the reversed indicia mirror reflection if the consumer desires to purchase the cosmetic; and D. Repeating steps A.–C. until the consumer decides to not sample any further cosmetics.

The cosmetic sampling method used for fingernail polish sample film 32 is as follows:

A. Superimposing a fingernail polish depiction 34 over a consumer fingernail;

B. Observing the superposition directly;

C. Noting the indicia 36 if the consumer desires to purchase that particular fingernail polish; and D. Repeating steps A.–C. until the consumer decides to not sample any further fingernail polish.

In the preferred embodiment, transparent film 4 was clear stiff plastic, celluloid, or other appropriate material. Cosmetic depictions 6, 22, 26, 30, 34, 42 and 46, reversed indicia 8 and indicia 36 were printed on transparent film 4 in any appropriate way: printing press, offset printing, color digital scanning and printing with a color printer, color photocopying, etc.

While a preferred embodiment of the invention has been illustrated herein, it is to be understood that changes and variations may be made by those skilled in the art without departing from the spirit of the appending claims.

DRAWING ITEM INDEX

2 lipstick sampler film
4 transparent film
6 lip depiction
8 reversed indicia
10 consumer
12 consumer lips
20 lip liner sampler film
22 lip liner depiction
24 eye shadow sampler film
26 eye shadow depiction
28 eye liner sampler film
30 eye liner depiction
32 fingernail polish sampler film
34 fingernail polish depiction
36 indicia
40 rouge sampler film
42 rouge depiction
44 face powder sampler film
46 face powder depiction
48 eye depiction
50 lips depiction

I claim:

1. A cosmetics sampler film comprising a stiff transparent film bearing at least two cosmetic depictions, each said cosmetic depiction being discrete and separate from any other said cosmetic depiction, and reversed indicia pertaining to and associated with each said cosmetic depiction, whereby an individual using said cosmetics sampler film may observe a mirror reflection of said cosmetics sampler film superimposed upon a part of said individual's body, and said individual can read a mirror reflection of said reversed indicia.

2. The cosmetics sampler film of claim 1 wherein said cosmetic sampler film is a lipstick sampler film and said at least one cosmetic depiction is a lip depiction.

3. The cosmetics sampler film of claim 1 wherein said cosmetic sampler film is a lip liner sampler film and said at least one cosmetic depiction is a lip liner depiction.

4. The cosmetics sampler film of claim 1 wherein said cosmetic sampler film is an eye shadow sampler film and said at least one cosmetic depiction is an eye shadow depiction.

5. The cosmetics sampler film of claim 1 wherein said cosmetic sampler film is an eye liner sampler film and said at least one cosmetic depiction is an eye liner depiction.

6. The cosmetics sampler film of claim 1 wherein said cosmetic sampler film is a rouge sampler film and said at least one cosmetic depiction is a rouge depiction.

7. The cosmetics sampler film of claim 1 wherein said cosmetic sampler film is a face powder sampler film and said at least one cosmetic depiction is a face powder depiction.

8. The cosmetics sampler film of claim 7 wherein each said face powder depiction comprises a pair of eye depictions and a lips depiction.

9. A cosmetics sampling method using a cosmetics sampler film, said cosmetics sampler film comprising a stiff transparent film bearing at least two cosmetic depictions, each said cosmetic depiction being discrete and separate from any other said cosmetic depiction, and reversed indicia pertaining to and associated with each said cosmetic depiction, said cosmetic depiction being a lip depiction, a lip liner depiction, an eye shadow depiction an eye liner depiction, a rouge depiction, or a face powder depiction, said cosmetics sampling method comprising the steps of:

A. Superimposing one said cosmetic depiction over a corresponding consumer body part;

B. Observing the superposition in a mirror; and

C. Noting a reversed indicia associated with one or more of said cosmetic depiction mirror reflection.

10. The cosmetics sampling method of claim 9 comprising the further step of repeating steps A.–C. until the consumer decides to not sample any further cosmetics.

* * * * *

UNITED STATES PATENT AND TRADEMARK OFFICE

CERTIFICATE OF CORRECTION

PATENT NO. : 6,598,608 B1
DATED : July 29, 2003
INVENTOR(S) : Downey, Margarita

It is certified that error appears in the above-identified patent and that said Letters Patent is hereby corrected as shown below:

Title page,
Item [57], ABSTRACT,
Line 1, "cosmetics sampling method…" should be -- A cosmetics sampling method… --

Column 1,
Line 58, "applicator, be,it an eyeliner…" should be -- applicator, be it an eyeliner… --

Column 8,
Line 3, "…eye shadow depiction an eye…" should be -- …eye shadow depiction, an eye… --

Signed and Sealed this

Twenty-eighth Day of October, 2003

JAMES E. ROGAN
*Director of the United States Patent and Trademark Office*